United States Patent [19]

Fanner

[11] Patent Number: 4,812,266

[45] Date of Patent: Mar. 14, 1989

[54] CARBURETOR ALTITUDE COMPENSATOR APPARATUS

[75] Inventor: John C. Fanner, Coon Rapids, Minn.

[73] Assignee: Onan Corporation, Minneapolis, Minn.

[21] Appl. No.: 103,106

[22] Filed: Sep. 30, 1987

[51] Int. Cl.[4] ..... F02M 7/18

[52] U.S. Cl. ..... 261/71; 261/DIG. 38

[58] Field of Search ..... 261/71, 121.4, DIG. 38

[56] References Cited

U.S. PATENT DOCUMENTS

| | | | |
|---|---|---|---|
| 1,196,976 | 3/1914 | Pembroke | 261/71 |
| 1,272,036 | 7/1918 | Greuter | 261/71 |
| 1,586,648 | 6/1926 | Boulade | 261/121.2 |
| 2,185,578 | 12/1936 | Beardsley, Jr. et al. | 261/39.2 |
| 2,791,409 | 5/1957 | Gauder | 261/71 |
| 2,951,690 | 9/1960 | Eberline | 261/71 |
| 3,170,006 | 2/1965 | Brown | 261/71 |
| 3,231,250 | 1/1966 | Kalert, Jr. | 261/71 |
| 3,313,532 | 4/1967 | Carlson et al. | 261/121.4 |
| 3,321,195 | 5/1967 | Korte | 261/71 |
| 3,469,825 | 9/1969 | Du Bois | 261/71 |
| 3,859,397 | 1/1975 | Tryon | 261/39 A |
| 4,052,490 | 10/1977 | Fedison | 261/71 |
| 4,094,932 | 6/1978 | Knox, Sr. | 261/71 |
| 4,097,563 | 6/1978 | Yuzawa | 261/121.4 |
| 4,177,224 | 12/1979 | Yamanaka et al. | 261/39 A |
| 4,208,361 | 6/1980 | Ushijima et al. | 261/121.4 |

FOREIGN PATENT DOCUMENTS

| | | | |
|---|---|---|---|
| 15653 | of 1912 | United Kingdom | 261/71 |

*Primary Examiner*—Tim Miles

*Attorney, Agent, or Firm*—Merchant, Gould, Smith, Edell, Welter & Schmidt

[57] ABSTRACT

Carburetor altitude compensator apparatus (20) includes fingertip adjustable fuel to air mixture adjustment screw (22). The adjustment screw (22) includes a tracking member (30) rotatable therewith and cooperating with a graduated scale (42) to indicate the altitude at which optimum fuel/air mixture is derived for any given setting of the adjustment screw (22). An indentation (34) cooperates with the tracking member (30) to limit the range of possible adjustment of the adjustment screw (22) so as to avoid engine damage regardless of what adjustment the adjustment screw (22) is set at.

7 Claims, 2 Drawing Sheets

FIG. 1
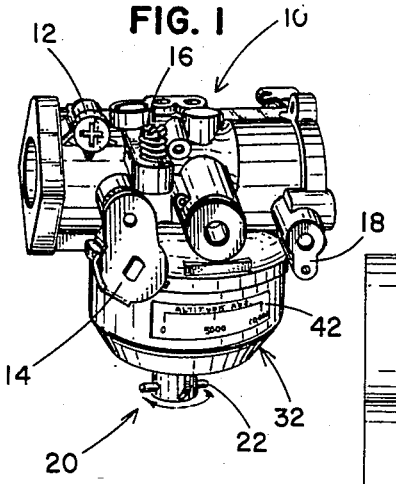
FIG. 2
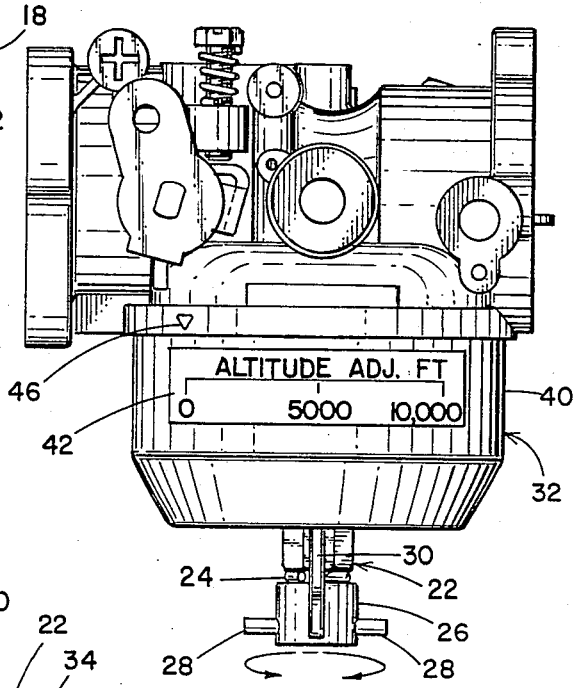
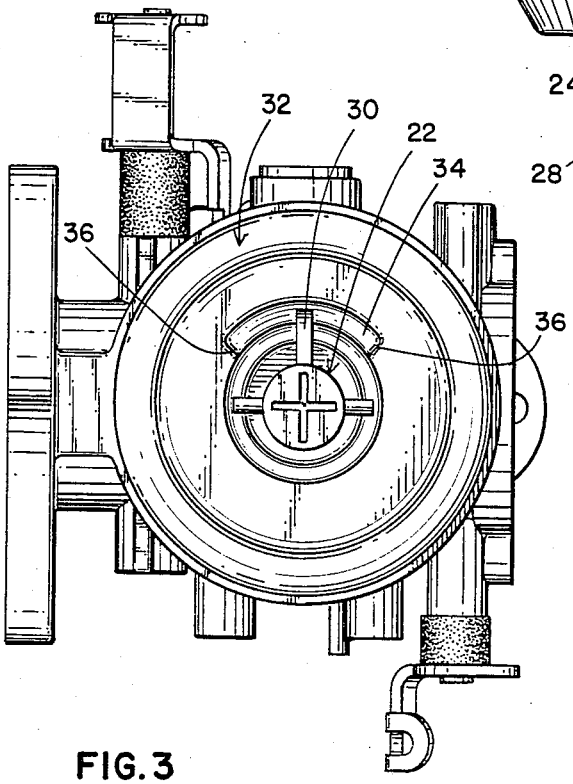
FIG. 3
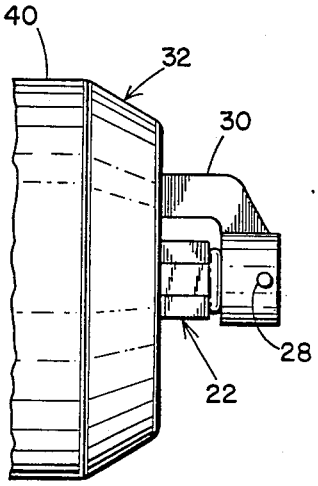
FIG. 4

CARBURETOR ALTITUDE COMPENSATOR APPARATUS

BACKGROUND OF THE INVENTION

The present invention relates to an apparatus and method providing for manual adjustment of the fuel mixture at the carburetor of a combustion engine. More particularly the present invention relates to a carburetor altitude compensator apparatus which provides for manual adjustment, said altitude compensator apparatus being scaled according to altitude, of the fuel mixture and which limits the amount of adjustment which can be made, the combustion engine operating over the range of adjustment regardless of the altitude.

Anyone who has used a recreational vehicle (RV) generator set in the mountains can greatly appreciate the problem of improper fuel mixture due to changes in altitude and its affect on engine performance. As altitude increases, the air to fuel mixture becomes too lean with regard to air for optimum engine operation. Likewise, a carburetor which has been adjusted for high altitudes, will result in reduced engine performance at lower altitudes.

Carburetors will typically have one or more fuel/air mixture control screws, also referred to as jets, for controlling fuel to air mixture in the carburetor at various stages of operation. It is well known to provide for variable adjustment of a carburetor's various jets which might be present; e.g., the idling jet, the main jet and the compensating jet. However, proper adjustment of the jets requires a substantial knowledge of carburetor/-combustion engine operation. Moreover, these jets are usually set by a skilled mechanic for operation at a specific altitude. Many RV owners and other users of combustion engines do not have the type of knowledge necessary to properly adjust the jets of the carburetor. Failure to properly adjust the carburetor's jets cannot only affect engine performance due to improper fuel mixture, but it can also result in actual engine damage through lack of, or incorrect compensation for the effects of varying elevation.

Automatic altimetric correcting apparatus for carburetors, especially airplanes, have been developed. However, they are typically rather complex and somewhat expensive to maintain. Their cost would typically not justify their use in many applications such as the RV market.

U.S. Pat. No. 4,094,932 issued to Knox, Sr. discloses a carburetor checking and adjustment apparatus. Knox provides a hand controlled device mounted on the dashboard of a vehicle for adjusting the carburetor from the dashboard and further includes an indicator on the dashboard for indicating when the carburetor is out of adjustment. In addition to other differences from the present invention, the Knox apparatus includes a rather complicated linkage between the carburetor and the hand controlled device on the dashboard. Moreover, the hand controlled device does not include any indication of altitude thereon. A separately actuated electrical indicator is used to indicate if the carburetor is out of adjustment. Additionally, there is no teaching of limiting the amount of carburetor adjustment so as to not adjust the carburetor beyond the operating range of the vehicle engine. Also, there are many uses of internal combustion engines where it is not necessary nor even desired to have the fuel/mixture control device located remotely of the engine's carburetor.

The present invention solves these and other problems related with existing carburetors.

SUMMARY OF THE INVENTION

The present invention relates to a carburetor altitude compensator apparatus used with a carburetor of an internal combustion engine. The invention includes a hand adjustable fuel/air mixture adjustment screw means positioned on the carburetor for adjusting the fuel to air ratio. An altitude indicator means indicates the altitude at which optimum fuel to air mixture is being derived at a current setting of the adjustment screw means. Limiting means is included for limiting the adjustment of the adjustment screw means to an operating range of fuel to air mixtures, thereby assuring that the engine will not stall or be damaged regardless of the setting of the adjustment screw means.

One advantage of the present invention is that it provides for fingertip adjustment of the fuel to air mixture within a physically limited range to allow only controlled altitude compensation thereby preventing inadvertent engine damage through improper adjustment of the fuel/air adjustment screw. Moreover, the invention includes altitude indicator means for indicating the altitude at which the adjustment screw is set for optimum engine performance. One can readily adjust the adjustment screw to derive optimum performance at a different elevation above sea level by fingertip adjustment of the adjustment screw to the location as indicated by the altitude indicator means.

The present invention limits the range of adjustment of the adjustment screw such that engine operation using a fuel/air mixture resulting in incomplete combustion or potential engine damage through lack of or incorrect compensation for the effects of varying elevation are avoided.

An advantage of one embodiment of the present invention is that it provides for maintaining optimum engine fueling over an operating range of elevation; e.g., zero to ten thousand feet, by fingertip dialing of the adjustment screw to the appropriate elevation as indicated by the indicator means without the necessity of any tools and without requiring any knowledge of how carburetors operate.

These and various other advantages and features of novelty which characterize the invention are pointed out with particularity in the claims annexed hereto and forming a part thereof. However, for a better understanding of the invention, its advantages, and its objects obtained by its use, reference should be made to the drawings which form a further part hereof, and to the accompanying descritive matter, in which there is illustrated and described a preferred embodiment of the invention.

BRIEF DESCRIPTION OF THE DRAWINGS

In the drawings wherein like reference numerals and letters indicate generally corresponding parts throughout the several views:

FIG. 1 is a perspective view of an embodiment of a carburetor including an embodiment of a carburetor altitude compensator apparatus in accordance with the principles of the present invention;

FIG. 2 is a elevation view of the embodiment shown in FIG. 1;

FIG. 3 is an bottom view of the embodiment shown in FIG. 1;

FIG. 4 is a partial side view of the embodiment shown in FIG. 1; and

DETAILED DESCRIPTION OF A PREFERRED EMBODIMENT

Figure 5:
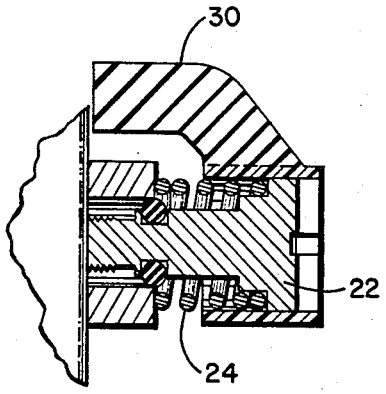
FIG. 5 is a cross sectional view of a variable jet screw/spring arrangement.

Referring now to FIGS. 1–4, there is shown an embodiment of a carburetor 10 including an embodiment of a carburetor altitude compensator apparatus generally in accordance with the principles of the present invention, the compensator apparatus being referred to by the reference numeral 20. The carburetor 10 shown is of conventional design including an idle adjustment screw 12, a throttle lever 14 interconnected to a butterfly valve (not shown), a throttle stop screw 16 and a choke 18. Typically, the carburetor 10 further includes a main variable power jet screw arrangement 22 typically comprising a compression spring 24 disposed between a head portion of a screw (as shown in the cutaway view of FIG. 5) and a base portion of the carburetor 10. The head of the screw will typically include a transverse screw driver slot (not shown). The coiled compression spring 24 assists in preventing the screw from moving from its adjusted position.

In the embodiment shown, the carburetor altitude compensator apparatus 20 includes the main power jet screw 22 as one of its elements. A plastic cap 26 is removably secured to an end of the main power jet screw 22. The plastic cap includes radially extending members 28 which can be readily grasped so as to provide fingertip adjustment of the screw 22 and thus the fuel/air mixture. The plastic cap 26 includes a tracking member 30 which extends radially from the cap 26 and axially toward the carburetor 10. In the embodiment shown, the members 28 and the tracking member 30 are of one piece with the cap 26. A fuel bowl portion 32 of the carburetor includes an arcuately shaped indentation 34 on a surface facing the tracking member 30. The tracking member 30 extends into the indentation 34 and thus has its range of rotatable motion limited by the end wall portions 36 of the indentation 34. In one embodiment, the range of motion of the tracking member 30 and thus the cap 26 is ninety degrees. Disposed on a radially facing surface 40 of the fuel bowl 32, is a graduated scale 42 which incidates the elevation at which optimum fuel/air mixture occurs for a given setting of the power jet screw 22 as indicated by alignment of the tracking member 30 with the graduated scale 42. In the embodiment shown, the scale 42 is calibrated in thousands of feet, namely zero feet, five thousand feet, and ten thousand feet. It will be appreciated that the scale might be calibrated over a different range of elevation. Additionally, the scale might be calibrated in other units of measurement, such as meters, etc. In the preferred embodiment, the graduated scale 42 is positioned such that the zero feet position is aligned with an alignment indicator 46 on the carburetor body and also with the end of the tracking member 30 when the tracking member is moved to its farthest most counterclockwise position. The alignment indicator 46 facilitates assembly and reassembly by providing a reference between the carburetor body and the carburetor bowl.

In operation, as changes occur in altitude, the user simply manually dials the power jet screw 22 by grasping the cap 26 and manually rotating power jet screw 22 until the tracking member 30 is aligned with the appropriate altitude indicator on the graduated scale 42.

It is to be understood, however, that even though numerous characteristics and advantages of the present invention have been set forth in the foregoing description, together with details of the structure and function of the invention, the disclosure is illustrative only, and changes may be made in detail, especially in matters of shape, size and arrangement of parts within the principles of the invention to the full extent indicated by the broad general meaning of the terms in which the appended claims are expressed.

What is claimed is:

1. A carburetor altitude compensator apparatus used with a carburetor of an internal combustion engine, comprising:

(a) a hand adjustable fuel/air mixture adjustment screw;

(b) an end cap secured to the adjustment screw and rotatable therewith, rotational motion being transmittable from the end cap to the adjustment screw, the end cap including a tracking member rotatable therewith and extending radially of and axially along the adjustment screw, a terminal end portion of the tracking member extending into an indentation of a fuel mixture bowl of the carburetor, the terminal end portion cooperating with limiting means of the carburetor for limiting adjustment of the fuel/air mixture adjustment screw to a range of fuel/air mixtures which assures operation of the engine over a predetermined range of altitudes whereby within the predetermined range of altitudes, the engine will not stall regardless of the positioning of the fuel/air mixture adjustment screw; and (c) altitude indicia scale means disposed on the carburetor for indicating in cooperation with the tracking member the altitude to which the fuel/air mixture adjustment screw is set for optimum engine performance.

2. An apparatus in accordance with claim 1, wherein the movement of the tracking member is limited by walls of the indentation.

3. An apparatus in accordance with claim 2, wherein the altitude indicia means includes a graduated scale calibrated in feet.

4. An apparatus in accordance with claim 3, wherein the end cap and tracking member are of one piece.

5. A carburetor altitude compensator apparatus used with a carburetor of an internal combustion engine, comprising:

(a) a hand adjustable fuel/air mixture adjustment screw;

(b) an end cap secured to the adjustable screw and rotatable therewith, rotational motion being transmittable from the end cap to the adjustment screw, the end cap including a tracking member rotatable therewith and extending radially of and axially along the adjustment screw, a terminal end portion of the tracking member cooperating with limiting means of the carburetor for limiting adjustment of the fuel/air mixture adjustment screw to a range of fuel/air mixtures which assures operation of the engine over a predetermined range of altitudes whereby within the predetermined range of altitudes, the engine will not stall regardless of the positioning of the fuel/air mixture adjustment screw;

(c) altitude indicia scale means disposed on the carburetor for indicating in cooperation with the tracking member the altitude to which the fuel/air mixture adjustment screw is set for optimum engine performance; and (d) a fuel bowl including an indentation wherein the racking member projects into the indentation, movement of the racking member being limited by walls of the indentation.

6. An apparatus in accordance with claim 5, wherein the altitude indicia means includes a graduated scale calibrated in feet.

7. An apparatus in accordsance with claim 6, wherein the end cap and tracking member are of one piece.

* * * * *

UNITED STATES PATENT AND TRADEMARK OFFICE

CERTIFICATE OF CORRECTION

PATENT NO. : 4,812,266

DATED : March 14, 1989

INVENTOR(S) : Fanner

It is certified that error appears in the above-identified patent and that said Letters Patent is hereby corrected as shown below:

Title page, Under U.S. PATENT DOCUMENTS, Line 5, "2,791,409 5/1957 Gauder" should be -- 2,791,409 5/1957 Lauder --.

Col. 3, line 48, "incidates" should be --indicates--.

Col. 6, line 1, "racking" should be --tracking--.

Col. 6, line 6, "accordsance" should be --accordance--.

Signed and Sealed this

Twenty-fourth Day of October, 1989

*Attest:*

*Attesting Officer*

DONALD J. QUIGG

*Commissioner of Patents and Trademarks*